US006405615B1

(12) United States Patent
Vermillion

(10) Patent No.: US 6,405,615 B1
(45) Date of Patent: Jun. 18, 2002

(54) FIXTURE FOR SNOWBOARD EDGE FINISHING TOOL

(76) Inventor: James H. Vermillion, 14220 Orchard Ave., Caldwell, ID (US) 83605

( * ) Notice: Subject to any disclaimer, the term of this patent is extended or adjusted under 35 U.S.C. 154(b) by 0 days.

(21) Appl. No.: 09/658,827

(22) Filed: Sep. 8, 2000

(51) Int. Cl.[7] ..... B23D 67/12

(52) U.S. Cl. ..... 76/83; 76/88; 407/29.15; 451/558

(58) Field of Search ..... 76/83, 88; 30/286, 30/289, 172; 7/158; 451/439, 557, 558, 162; 407/29.1, 29.15

(56) References Cited

U.S. PATENT DOCUMENTS

| | | | | | |
|---|---|---|---|---|---|
| 69,993 | A | * | 10/1867 | Haynes | 76/88 |
| 612,820 | A | * | 10/1898 | Bush | 451/558 |
| 838,268 | A | * | 12/1906 | Paschall | 451/558 |
| 1,081,606 | A | * | 12/1913 | Gray et al. | 76/88 |
| 1,305,283 | A | * | 6/1919 | Heckmann | 407/29.15 |
| 1,666,993 | A | * | 4/1928 | Corke | 76/83 |
| 3,934,287 | A | | 1/1976 | Howard | 7/14.1 R |
| 3,991,429 | A | | 11/1976 | Honauer | 7/14.1 R |
| 4,030,382 | A | | 6/1977 | Nilsson et al. | 76/83 |
| 4,078,455 | A | * | 3/1978 | Brody | 76/88 |
| 4,089,076 | A | | 5/1978 | Sparling | 7/158 |
| 4,189,874 | A | | 2/1980 | Labriola | 51/181 R |
| 4,241,624 | A | | 12/1980 | Strojny | 76/83 |
| 4,630,409 | A | | 12/1986 | Hofstetter | 51/361 |
| 4,998,956 | A | | 3/1991 | Sherman | 76/83 |
| 5,485,768 | A | | 1/1996 | Vermillion | 76/83 |
| 5,643,066 | A | | 7/1997 | Vermillion | 451/442 |
| 5,701,787 | A | * | 12/1997 | Brill | 76/83 |

* cited by examiner

*Primary Examiner*—Hwei-Slu Payer
(74) *Attorney, Agent, or Firm*—Joseph W. Holland

(57) ABSTRACT

A fixture for positioning an abrasive tool above a running surface of a snowboard for beveling a snowboard edge including a head having one or more feet, each foot including an indexing portion for indexing the fixture against a marginal side of the snowboard. An arm is connected to and projects from the head and a carrier is connected to the arm at a predetermined distance from the indexing portion of the foot. The carrier includes a tool shim. When the fixture is in use, the tool shim bottom face may be held in sliding contact with in a plane substantially parallel to the running surface of the snowboard at a predetermined and fixed distance from the marginal side of the snowboard. A finishing tool, such as a file, is held at a predetermined working angle relative to the running surface of the snowboard by spanning the file between the upper face of the tool shim and the edge of the snowboard. The working angle of the bevel may be varied by advancing the arm through the carrier.

15 Claims, 5 Drawing Sheets

FIXTURE FOR SNOWBOARD EDGE FINISHING TOOL

BACKGROUND OF THE INVENTION

1. Technical Field

This invention relates generally to snowboard maintenance equipment and more specifically to a guide for holding and positioning a file or other abrasive device to hold the cutting or other abrasive face in a predetermined plane relative to the bottom running face of the snowboard and therefore the edge of the snowboard for controlling the angle at which the metal edge of the snowboard is finished.

2. Background

The craft of maintaining and preparing snowboards for use, both by recreational snowboarders and racers, has evolved to a relatively advanced state. The expectations of both the snowboarder and maintenance personnel regarding the performance of the snowboard as a result of tuning has increased dramatically over the last several years. Both the bases and the edges of snowboards are tuned to exacting specifications depending upon the intended use by the snowboarder. While the object of snowboard tuning has evolved significantly, it continues to be an object of the edge sharpening procedure to create a consistently smooth, sharp edge having a side edge portion which is substantially perpendicular to the running base of the snowboard and a bottom face of the metal snowboard edge which is cut at anywhere from zero degrees, or parallel to the running base of the snowboard, to five or seven degrees as desired by the snowboarder, or as required by conditions.

Snowboard tuning may be performed in shops, where the technician is likely to have a work bench and a means, typically a vise, for holding the snowboard secured in a predetermined orientation, typically with the base up. Alternately, snowboard tuning may be done at the last minute on the snowboard slope or just prior to a race, depending on existing or changing conditions. Additionally, snowboard tuning is performed by individuals having a range of experience, including well trained and seasoned individuals to those who have had relatively no experience or who may be simply seasonal employees.

Numerous devices have been disclosed for tuning the metal edge of a ski. Among these are Honauer, U.S. Pat. No. 3,991,429, Apparatus for Sharpening Edges of Skis, Sparling, U.S. Pat. No. 4,089,076, Ski Servicing and Repair Tool and Labriola, U.S. Pat. No. 4,189,874, Hand Held Pocket Sized Ski Repair and Maintenance Tool.

Other tools and fixtures have been disclosed which provide a means for filing both the vertical side face of the metal edge and the bottom face of the metal edge of a ski. Sherman, U.S. Pat. No. 4,998,956, discloses a sharpener for sharpening the vertical and horizontal metallic edge surfaces of a ski or snow board. Howard, U.S. Pat. No 3,934,287, Combination Ski Maintenance Tool, discloses a tool or fixture for holding a file for flat filing the running base of a ski. Nilsson, et. al., U.S. Pat. No. 4,030,382, Sharpening Device for Steel Ski Edge Strips, discloses a tool for sharpening the side face of the metal edge of a ski and provides means for bending the file blade to limit the cutting action to a few teeth at a time. Strojny, U.S. Pat. No. 4,241,624, Edge Sharpener, discloses a device for holding a file which may be used to file either the side face of a metal edge or the bottom face of a metal edge. Hofstetter, U.S. Pat. No. 4,630,409, discloses a device for finishing the edges of a ski which has a base plate which moves along the base of the ski with a pair of blocks having finishing surfaces disposed on either side of the base plate for simultaneously finishing the bottom face of either of the two metal edges of the ski. Vermillion, U.S. Pat. No. 5,485,768, Ski Sharpening Guide, claims a ski sharpening guide for use with a file for sharpening the edges of a ski. Finally, Vermillion, U.S. Pat. No. 5,643,066, Fixture for Ski Edge Finishing Tool, discloses a fixture for positioning a file or other abrasive finishing tool relative to the running surface of a ski so that the bottom face of the ski edge may be beveled. The fixture is configured to allow either or both the angle and the width of the bottom face of the edge that is finished to be varied.

Configurations of skis and snowboards vary substantially. The width and length of a snowboard varies substantially from the width of a ski. Edge design, sidecuts and camber requirements for ski and snowboard design respectively also vary substantially. Similarly, the performance requirements for a ski vary from the performance requirements for snowboards. Insofar as configurations and performance requirements for skis and snowboards vary, many tools available for ski tuning are unadaptable to snowboard tuning.

While the above referenced devices serve a variety of purposes relative to the craft of ski tuning and finishing, what is needed is a simple hand held fixture for positioning and orienting a file or other finishing tool at a predetermined height and a predetermined angle relative to the running base of a snowboard and therefore the metal edge of the snowboard for finishing the bottom face of the metal edge of the snowboard at a predetermined angle relative to the flat running base of the snowboard and/or at a predetermined width from the marginal edge of the snowboard.

An object of the present invention is to provide a fixture for holding or positioning a finishing tool which allows the angle at which the file is held relative to the running base of the snowboard to be adjusted.

Another object of the present invention is to provide a fixture for positioning and orienting a finishing tool at a predetermined angle relative to the running base of the snowboard which is simple to index against the running base and the marginal side of the snowboard so that a relatively untrained individual is capable of producing and repeating consistent results.

SUMMARY OF THE INVENTION

According to the present invention, these and other objects are achieved by a fixture for positioning an abrasive tool for finishing a snowboard edge so that the bottom face of the snowboard edge is beveled relative to the base of the snowboard. The fixture includes a head member having a foot which supports the head above the base of the snowboard. An arm projects from the head for, preferably, adjustable attachment to a carrier. The carrier includes a tool shim forming a base of the carrier. The tool shim includes a top face, a bottom face and a shim thickness defined by the distance between the top face and the bottom face. When the fixture is in use, the tool shim bottom face lies in a plane substantially parallel to the base of the snowboard and may be held in sliding contact with the base of the snowboard at a predetermined and fixed distance from the marginal side of the snowboard.

The foot is configured including an indexing portion for indexing the fixture against the marginal side of the snowboard. The indexing portion includes a base indexing face which lies in a plane substantially parallel to the base of the snowboard when the fixture is in use. The indexing portion also includes a marginal side indexing surface which lies in a plane substantially parallel to the marginal side of the snowboard and serves to hold the carrier with its associated tool shim at a predetermined and fixed distance from the marginal side of the snowboard when the fixture is in use.

In one preferred embodiment of the invention, the fixture includes a head member having a pair of feet supporting the head above the base of the snowboard. The feet may be fabricated from a nylon, plastic or Teflon® material which allows the fixture to slide easily along the length of the snowboard allowing the fixture to accurately engage and index against the base and the marginal side of the metal edge of the snowboard.

A finishing tool, such as a file, is held at a predetermined working angle relative to the base of the snowboard by spanning the file between the shim and the edge of the snowboard. The working angle of the bevel may be varied by advancing the arm through the carrier, effectively shortening an opposite side of a triangle defined by a plane defining a working face of the finishing tool, the base of the snowboard and the shim thickness.

In one preferred embodiment of the invention, the feet, the carrier and the arm are all replaceable or interchangeable. Alternately, the fixture may be offered to a user in a fixed version wherein various parts are not replaceable. In this embodiment, a variety of tools having different fixed configurations would be manufactured and offered for use to provide a variety of bevel angles.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Figure 1:
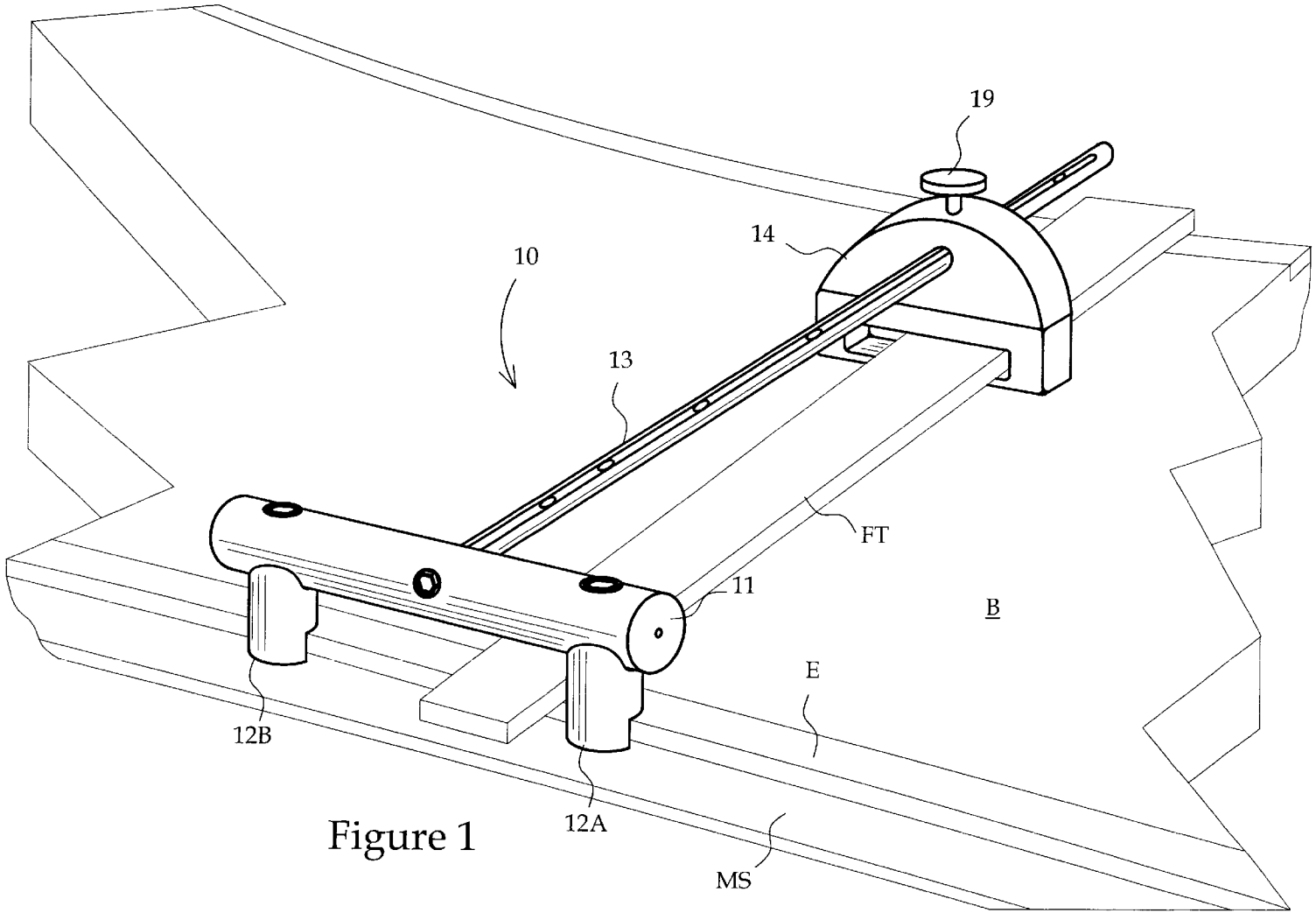
FIG. 1 is an representational perspective view of one embodiment of the present invention.

Referring now to FIGS. 1 through 5, fixture 10 for positioning a finishing tool for beveling a snowboard edge will be more fully described and understood. As shown in FIG. 1, fixture 10 includes head 11 having feet 12A and 12B extending from head 11 for supporting head 11 above base B of snowboard S. Arm 13 is connected to and projects from head 11 and slidingly engages carrier 14. Carrier 14 is slidingly adjustable along arm 13. Carrier 14 also includes thumbscrew 19 for securing carrier 14 along the length of arm 13. FIG. 1 shows finishing tool FT positioned in fixture 10.

Figure 2:
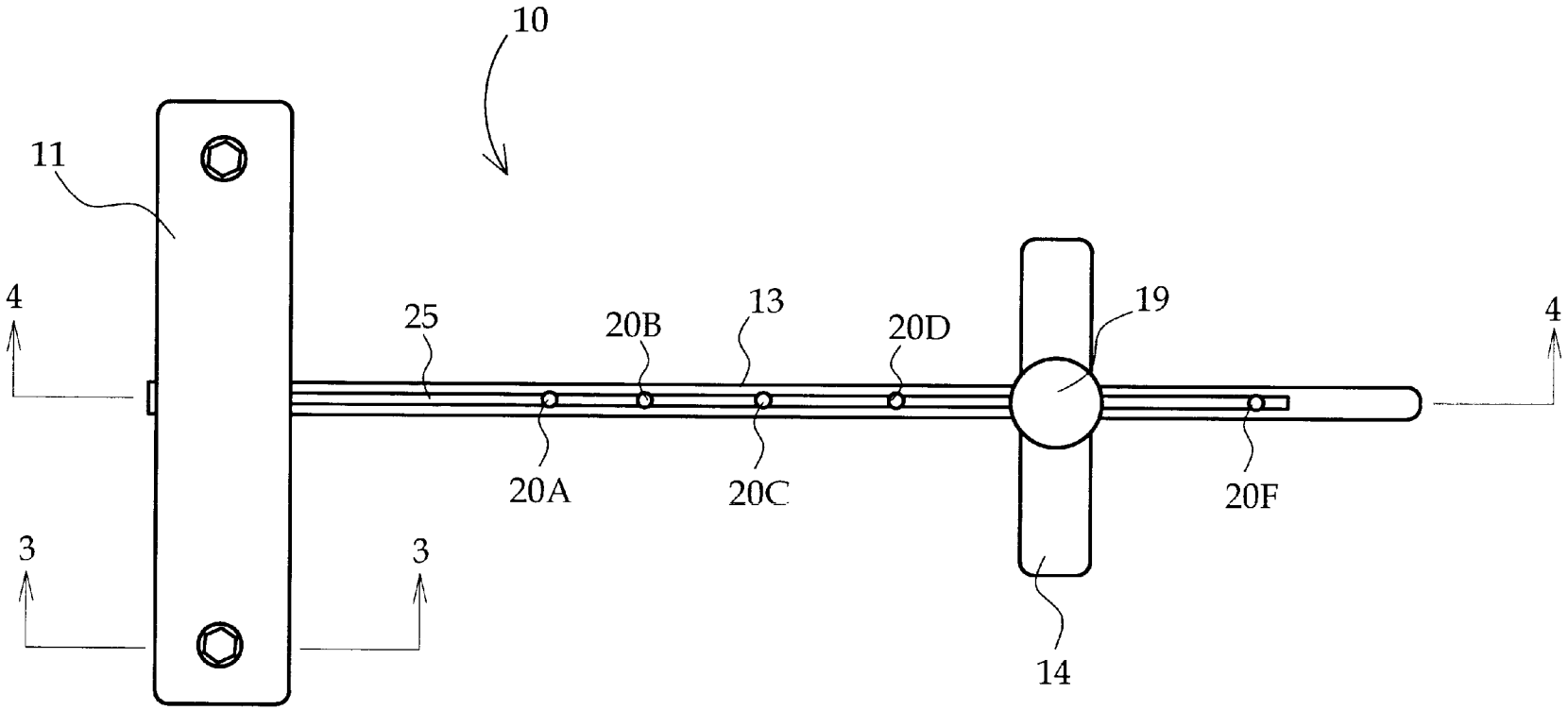
FIG. 2 is a representational top elevation view of one embodiment of the present invention.

FIG. 2 is a representational top elevation view of fixture 10 shown including head 11. Arm 13 is connected to and projects from head 11 and slidingly engages carrier 14. Carrier 14 is slidingly adjustable along arm 13. Carrier 14 also includes thumbscrew 19 for securing carrier 14 along the length of arm 13. Arm 13 is also shown including keyway 25 including a plurality of indexing stops 20A through 20F. (Indexing stop 20E not shown in FIG. 2).

Figure 3:
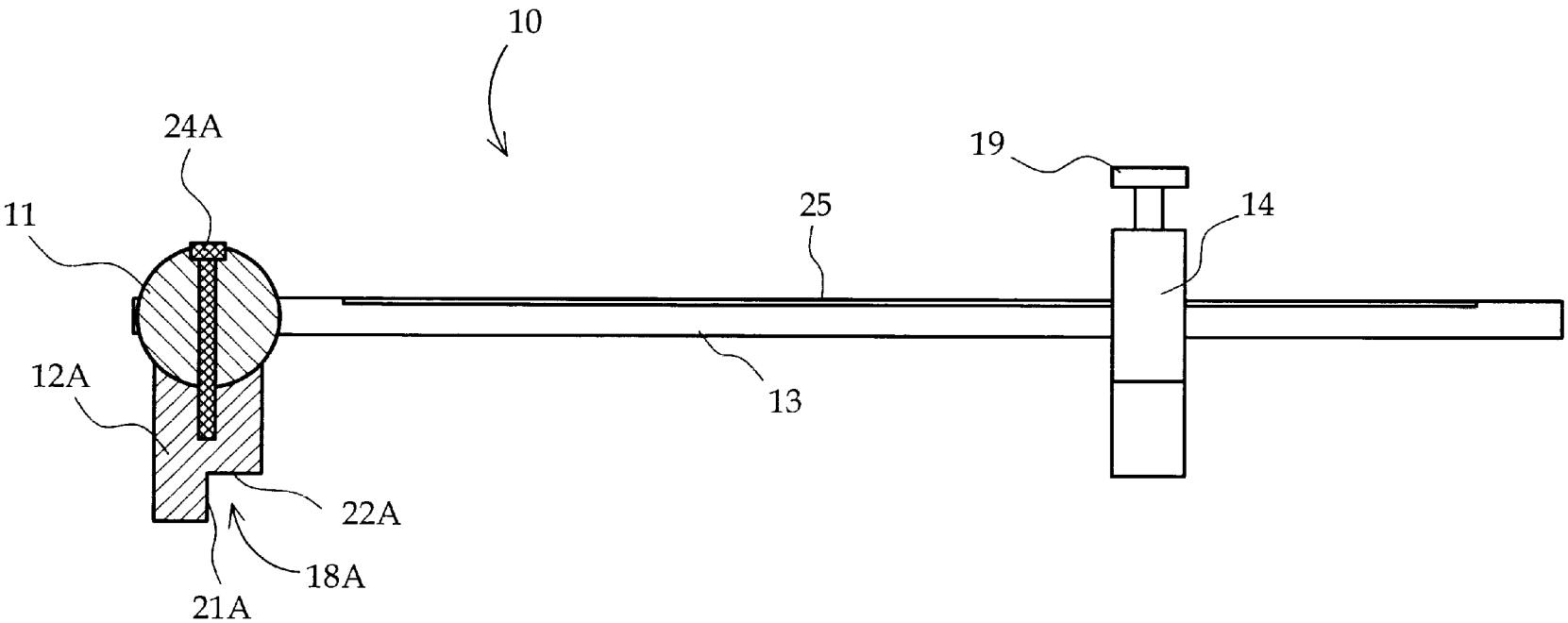
FIG. 3 is a representational side cutaway view of one embodiment of the present invention.

FIG. 3 is a representational side cutaway view of fixture 10 shown including head 11. Arm 13 is connected to and projects from head 11 and slidingly engages carrier 14. Keyway 25 extends the length of arm 13. Carrier 14 is slidingly adjustable along arm 13. Carrier 14 includes thumbscrew 19 for securing carrier 14 along the length of arm 13. The cutaway section of FIG. 3 is taken through foot 12A, (which is typical of foot 12B). Foot 12A is shown attached to head 11 by screw 24A. FIG. 3 shows indexing portion 18A to advantage. Indexing portion 18A includes substantially vertical face 21A and an intersecting substantially horizontal face 22A.

Figure 4:
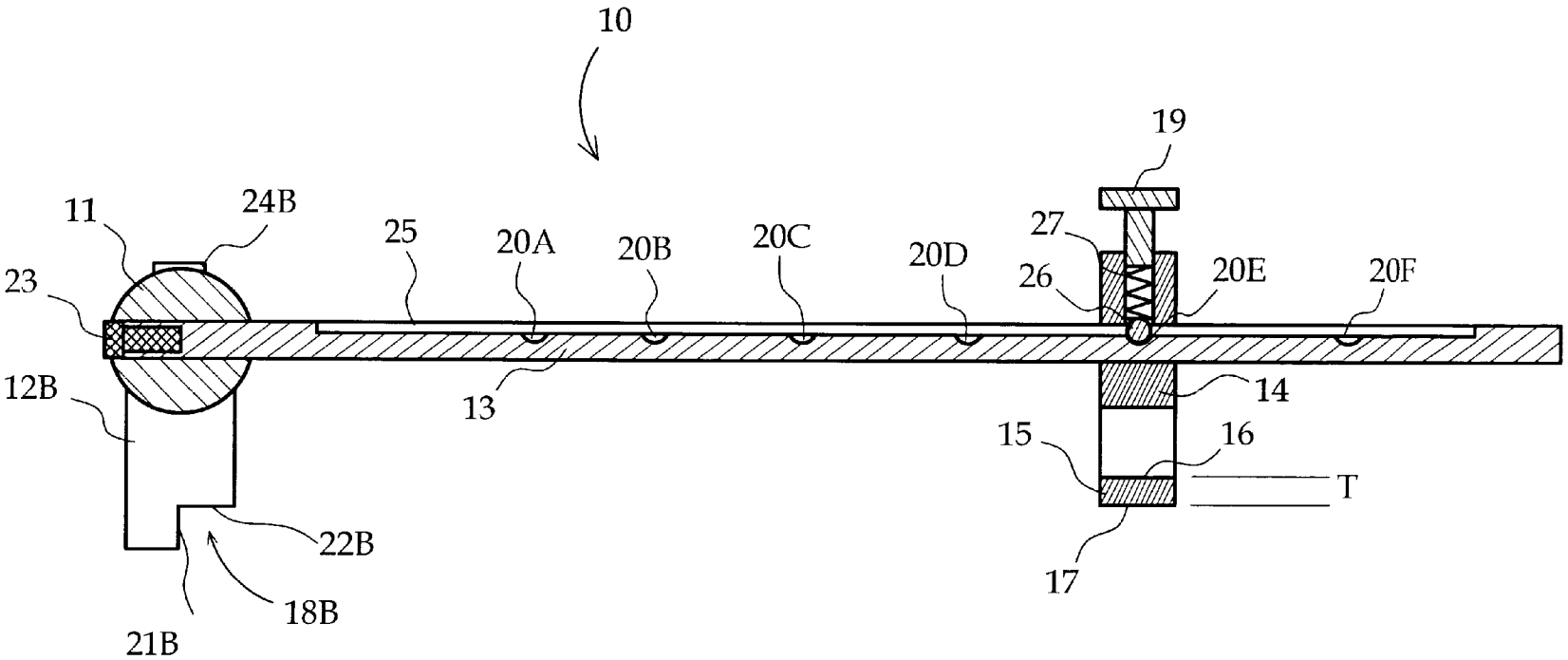
FIG. 4 is a representational side cutaway view of one embodiment of the present invention.
Figure 5:
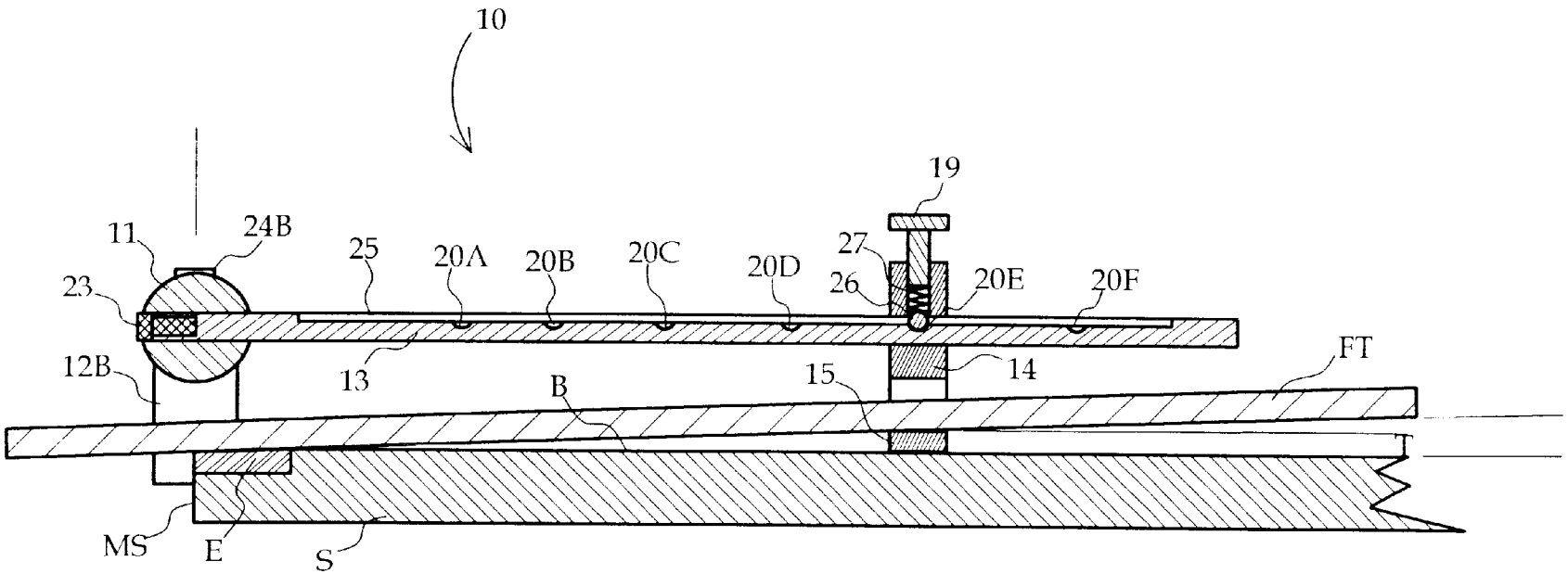
FIG. 5 is a representational side cutaway view of one embodiment of the present invention.

FIGS. 4 and 5 are representational side cutaway views of fixture 10 shown including head 11. Foot 12B is shown attached to head 11 by screw 24B. FIG. 4 also shows indexing portion 18B to advantage. Indexing portion 18B includes substantially vertical face 21B and an intersecting substantially horizontal face 22B. Substantially vertical face 21B slidingly engages marginal side MS and intersecting substantially horizontal face 22B slidingly engages edge E of base B as shown in FIG. 1.

The cutaway sections of FIGS. 4 and 5 are taken through arm 13 and show details of arm 13 and carrier 14 to advantage. Arm 13 is connected to and projects from head 11 and slidingly engages carrier 14. Arm 13 is removably attached to head 11 by screw 23. Arm 13 is also shown including keyway 25 including a plurality of indexing stops 20A through 20F.

Carrier 14 is slidingly adjustable along arm 13. Carrier 14 includes thumbscrew 19 for securing carrier 14 along the length of arm 13. Thumbscrew 19 may be advanced against spring 27 which maintains a compressive bias against ball 26. Ball 26 of carrier 14 tracks along keyway 25 during adjustment of carrier 14 along arm 13. Indexing stops 20A through 20F are positioned along the length of arm 13 at specific predetermined intervals to provide a desired working angle $\alpha$, (shown in FIG. 5). When ball 26 reaches one of the indexing stops 20A through 20F, it is forced into the indexing stop and may be secured in position by tightening thumbscrew 19.

Carrier 14 is shown including tool shim 15 which is configured to include top face 16, bottom face 17 and shim thickness T defined by the distance between top face 16 and bottom face 17, shown at FIG. 4. Referring to FIG. 5, when fixture 10 is in use, tool shim top face 16 lies in a plane substantially parallel to base B of snowboard S with the plane of top face 16 being offset from the elevation base B. Fixture 10 is configured so that bottom face 17 of carrier may be held in sliding contact with the base B at a predetermined and fixed distance from the marginal side MS of the snowboard. Finishing tool FT, is held at a predetermined working angle $\alpha$ relative to base B by spanning finishing tool FT between tool shim 15 and edge E of snowboard S. Working angle $\alpha$ may be varied by advancing arm 13 through the carrier 14.

In the embodiment shown in FIG. 5 for example, fixture 10 is supported on base by horizontal face 22A, (shown in FIG. 3), and horizontal face 22B, (shown in FIG. 4) and bottom face 17 of tool shim 15. Working angle $\alpha$ is determined by the height of tool shim 15 and the distance between a point where finishing tool FT contacts the outermost corner of edge E and top face 16 of tool shim 15. This distance is adjustable by advancing carrier 14 along arm 13.

Indexing stops 20A through 20F are positioned along the length of arm 13 at specific predetermined intervals to provide a desired working angle α, in this case, when carrier 14 is set at indexing stop 20A working angle α is equal to 2 degrees, when carrier 14 is set at indexing stop 20B working angle α is equal to 1.5 degrees, when carrier 14 is set at indexing stop 20C working angle α is equal to 1 degree, when carrier 14 is set at indexing stop 20D working angle α is equal to ¾ degree and when carrier 14 is set at indexing stop 20E working angle α is equal to ½ degree. While there is shown and described the preferred embodiment of the invention, it is to be distinctly understood that this invention is not limited thereto but may be variously embodied to practice within the scope of the following claims.

I claim:

1. A fixture for positioning an abrasive tool above a running surface of a snowboard for beveling a snowboard edge comprising:

a head including a foot, the foot including an indexing portion for indexing the fixture against a marginal side of the snowboard;

an arm connected to and projecting from the head, the arm further comprising an indexing stop located along the length of the arm;

a carrier connected to the arm at a predetermined distance from the indexing portion of the foot, the carrier including a tool shim having a top face, a bottom face and a shim thickness defined by the distance between the top face and the bottom face.

2. The fixture of claim 1 wherein the indexing portion further comprises:

a substantially vertical face of the foot for sliding engagement along the marginal side of the snowboard; and an intersecting and substantially horizontal face of the foot for sliding engagement along the running surface of the snowboard.

3. The fixture of claim 1 wherein the arm is removably connected to and projecting from the head.

4. The fixture of claim 1 wherein the carrier is slidingly adjustable along the arm.

5. The fixture of claim 1 wherein the foot is fabricated from a polymer.

6. The fixture of claim 1 wherein the foot is fabricated from a material selected from the group of materials comprising plastic, nylon and Teflon®.

7. The fixture of claim 1 wherein the foot is removably connected to the head.

8. A fixture for positioning an abrasive tool above a running surface of a snowboard for beveling a snowboard edge comprising:

a head including a first foot and a second foot, the first foot and the second foot including an indexing portion for indexing the fixture against a marginal side of the snowboard;

an arm connected to and projecting from the head; and a carrier connected to the arm at a predetermined distance from the indexing portion of the foot, the carrier including a tool shim having a top face, a bottom face and a shim thickness defined by the distance between the top face and the bottom face.

9. The fixture of claim 8 wherein the indexing portion further comprises:

a substantially vertical face of the first foot and the second foot for sliding engagement along the marginal side of the snowboard; and an intersecting and substantially horizontal face of the first foot and the second foot for sliding engagement along the running surface of the snowboard.

10. The fixture of claim 8 wherein the arm further comprises an indexing stop located along the length of the arm.

11. The fixture of claim 8 wherein the arm is removably connected to and projecting from the head.

12. The fixture of claim 8 wherein the carrier is slidingly adjustable along the arm.

13. The fixture of claim 8 wherein the first foot and the second foot are fabricated from a polymer.

14. The fixture of claim 8 wherein the first foot and the second foot are fabricated from a material selected from the group of materials comprising plastic, nylon and Teflon®.

15. The fixture of claim 8 wherein the first foot and the second foot are removably connected to the head.

* * * * *